US005890373A

United States Patent [19]

Smith

[11] Patent Number: 5,890,373

[45] Date of Patent: Apr. 6, 1999

[54] ROOM AIR CONDITIONER DESIGN

[76] Inventor: Gerald C. Smith, 1703 Patty Dr., Canyon Lake, Tex. 78133

[21] Appl. No.: 911,344

[22] Filed: Aug. 14, 1997

[51] Int. Cl.[6] ..... F25D 17/06

[52] U.S. Cl. ..... 62/428; 62/419; 165/125

[58] Field of Search ..... 62/404, 419, 426, 62/428, 296, 262; 165/122, 125

[56] References Cited

U.S. PATENT DOCUMENTS

| | | | |
|---|---|---|---|
| 2,056,041 | 9/1936 | Erbach | 62/419 |
| 2,165,480 | 7/1939 | Hastings | 62/419 |
| 2,486,145 | 10/1949 | Frie | 62/426 |
| 2,495,351 | 1/1950 | Smith | 62/426 |
| 2,591,178 | 4/1952 | McAdam | 62/419 |
| 3,001,384 | 9/1961 | Hanson et al. | 62/419 |
| 3,125,089 | 3/1964 | Taylor | 62/419 |
| 3,766,750 | 10/1973 | Aoh et al. | 62/259.1 |
| 3,799,255 | 3/1974 | Luderssen | 165/122 |
| 5,592,829 | 1/1997 | Kim | 62/428 |

*Primary Examiner*—William Doerrler

[57] ABSTRACT

The invention is of a new design for a room air conditioner. An air conditioner according to the present design will emit a substantially lower operating noise level than units of comparable cooling capacity and energy consumption. Additionally, the present design prescribes a coil design which requires approximately one-third less aluminum and copper than similarly performing room air conditioner units. The benefits of the present design arise from its reliance on a single row, wrap-around coil design which is used in conjunction with a tangential blower assembly. The single row evaporator coil of the present invention inherently produces less "wind noise" than multiple row coils. The positioning of the blower relative to the evaporator coil (the blower is enveloped by the coil in the preferred embodiment) and the positioning of the evaporator coil relative to the inner wall of the unit (which separates interior from exterior space) causes room air to flow into the space defined by the wrap-around evaporator coil from all directions, including the space adjacent to the inner wall, which air flow reduces the temperature gradient across the inner wall and reduces chassis insulation requirements.

1 Claim, 6 Drawing Sheets

CORRECTION FACTORS

| SURFACE | EDGE | 1Row | 2Row | 3Row | 4Row | 5Row | 6Row |
|---|---|---|---|---|---|---|---|
| CORR | STR. | 1.00 | 1.00 | 1.00 | 1.00 | 1.00 | 1.00 |
| CORR | RIP. | 1.05 | 1.04 | 1.03 | 1.02 | 1.01 | 1.00 |

| FPI | DRY COIL | WET COIL |
|---|---|---|
| 6 | 0.63 | 0.83 |
| 7 | 0.69 | 0.90 |
| 8 | 0.75 | 0.97 |
| 9 | 0.81 | 1.13 |
| 10 | 0.88 | 1.23 |
| 11 | 0.94 | 1.41 |
| 12 | 1.00 | 1.50 |
| 13 | 1.07 | 1.71 |
| 14 | 1.13 | 1.81 |
| 15 | 1.19 | 2.02 |
| 16 | 1.26 | 2.19 |
| 17 | 1.31 | 2.41 |
| 18 | 1.38 | 2.63 |

AIR TEMPERATURE FACTORS

| °F | FACTOR | °F | FACTOR |
|---|---|---|---|
| 50 | .77 | 100 | 1.05 |
| 0 | .87 | 150 | 1.15 |
| 50 | .96 | 200 | 1.25 |
| 70 | 1.00 | 250 | 1.35 |

$P.D._{Actual} = P.D._{Curve} \times$ CORR FACTORS

FIG. 4A

ROOM AIR CONDITIONER DESIGN

BACKGROUND OF THE INVENTION

1. Field of The Invention

Applicant's invention relates to air conditioning systems.

2. Background Information

Despite the prevalence of central heating and air conditioning systems in modern home and apartment construction, there remains a very large market and need for room-sized air conditioners.

Users of room air conditioners (also known by many as "window units") often fault the units because of the noise which they tend to generate. While the compressor and fan motor(s) of conventional room air conditioners do contribute to the units' operating noise, much of the noise heard by persons nearby a room air conditioner arises from the air flow through the units' evaporator coil assemblies.

In many circumstances, using room air conditioner(s) in lieu of central HVAC systems to cool only used portions of a dwelling can represent a substantial energy savings—something which benefits the resident from a financial standpoint, and, for obvious reasons, affords ecological benefits as well. Making available a room air conditioner which obviates the bases for consumer resistance to use of room air conditioners (noise being a principal one) could effect wide-spread benefits, as just mentioned.

Part of any effort to launch a new product, especially if to do so will necessarily require the participation of existing industry manufacturers, and even if it is a societally beneficial product, includes enticements to manufacturers to make the necessary investments to change production lines, etc. Enticements may be in the form of some promise of a larger, new market, or might relate to manufacturing or marketing efficiencies (and thus larger profits) in serving existing markets.

At least in part in view of the above, it would be desirable to make available to the consuming public a design for a room air conditioner unit which: (1) emits a substantially lower operating noise level than conventional units of comparable performance; (2) affords substantial material and manufacturing savings for those who make the unit; and (3) is highly energy efficient.

SUMMARY OF THE INVENTION

In view of the above, it is an object of the present invention to provide a novel room air conditioner unit design any embodiment of which emits a substantially reduced operating noise level when compared with units of comparable performance (comparable cooling capacity and energy consumption).

It is another object of the present invention to provide a novel room air conditioner unit the manufacture of which may be completed at lower costs than units of comparable performance.

It is another object of the present invention to provide a novel room air conditioner unit design any embodiment of which emits a substantially reduced operating noise level, and affords economies of manufacture, both when compared with units of comparable performance.

It is another object of the present invention to provide a novel room air conditioner unit design, the evaporator coil portion of any embodiment of which requires a lesser quantity of aluminum and copper when compared to comparable performance.

It is another object of the present invention to provide as a novel room air conditioner unit design, any embodiment of which requires a lesser quantity of inner wall insulation than units of comparable performance.

In satisfaction of these and related objectives, the present invention provides a new design for a room air conditioner. An air conditioner according to the present design will emit a substantially lower operating noise level than units of comparable cooling capacity and energy consumption. Additionally, the present design prescribes a coil design which requires approximately one-third less aluminum and copper than similarly performing room air conditioner units.

The benefits of the present design arise from its reliance on a single row, wrap-around coil design which is used in conjunction with a tangential blower assembly. The single row evaporator coil of the present invention inherently produces less "wind noise" than multiple row coils. The positioning of the blower relative to the evaporator coil (the blower is enveloped by the coil in the preferred embodiment) and the positioning of the evaporator coil relative to the inner wall of the unit (which separates interior from exterior space) causes room air to flow into the space defined by the wrap-around evaporator coil from all directions, including the space adjacent to the inner wall. This means that the temperature of room air is that which defines the room-side portion of the temperature gradient across the inner wall (the outside air temperature being the other component). This contrasts with conventional room air conditioner design which causes evaporator coil effluent air flow to impact or otherwise lie adjacent to the inner wall, thereby creating a substantially greater temperature gradient, and requiring a substantially larger quantum of inner wall insulation.

The use of a single layer evaporator coil in embodiments of the present invention, coupled with an optimal blower assembly, affords the opportunity for manufacturers to provide cooling performance and energy consumption levels at a unit evaporator coil constituent metal composition which is significantly lower (about ⅓ lower) than air conditioner units of comparable performance and energy consumption. Given the high cost of aluminum and copper (the principal constituent metals for evaporator coil construction), practice of the present invention affords substantial manufacturing economies.

DETAILED DESCRIPTION OF THE PREFERRED EMBODIMENT

An understanding of the departure of the present design from conventional room air conditioner design, as well as the benefits which arise from such a departure, begins with the simple observation that a given volume of air passing through a first unit surface area of evaporator coiling at a stated flow rate will produce a lower noise level than the same volume of air passing at the same flow rate through a larger surface area of evaporator coiling.

Figure 1:
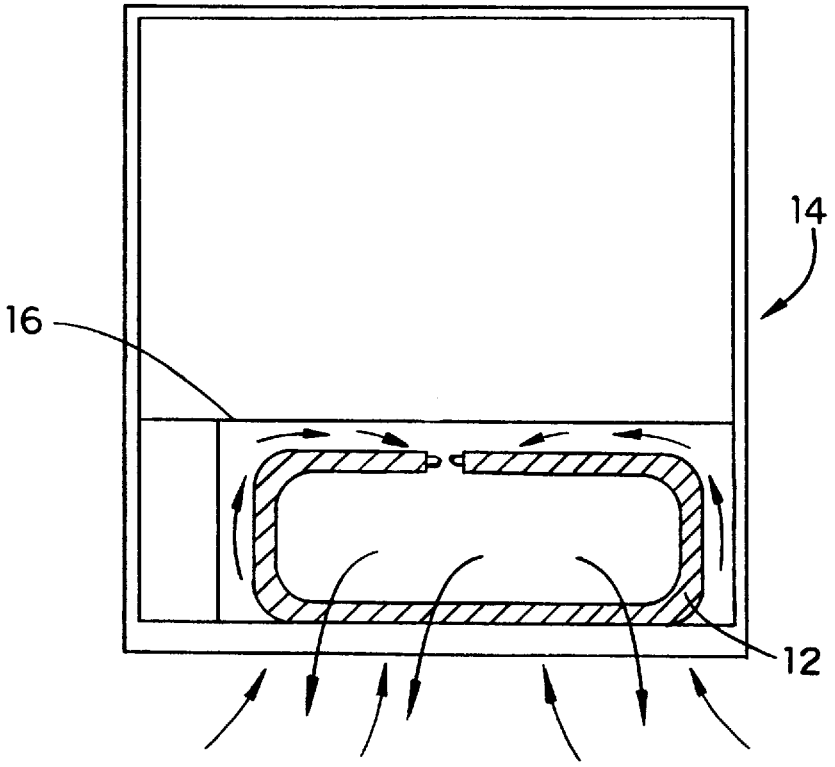
FIG. 1 is a top plan depiction of the component layout of a room air conditioner of the present invention.
Figure 2:
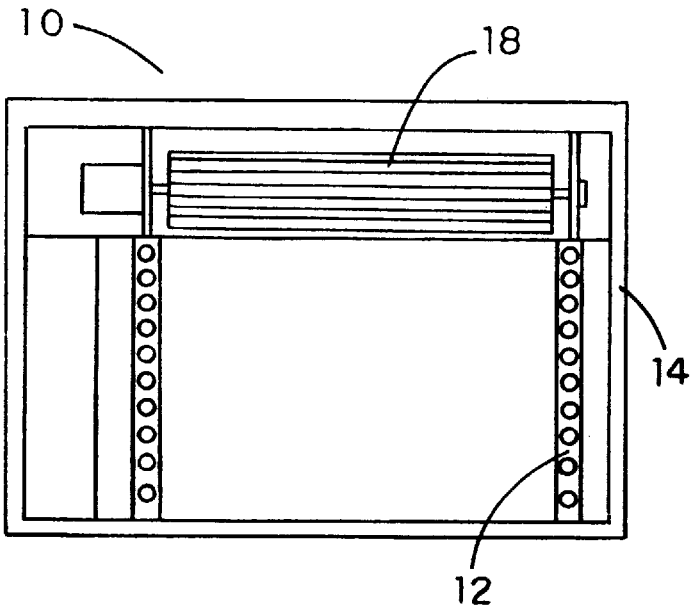
FIG. 2 is a front elevational, partially cut-away depiction of the air conditioner of FIG. 1.
Figure 3:
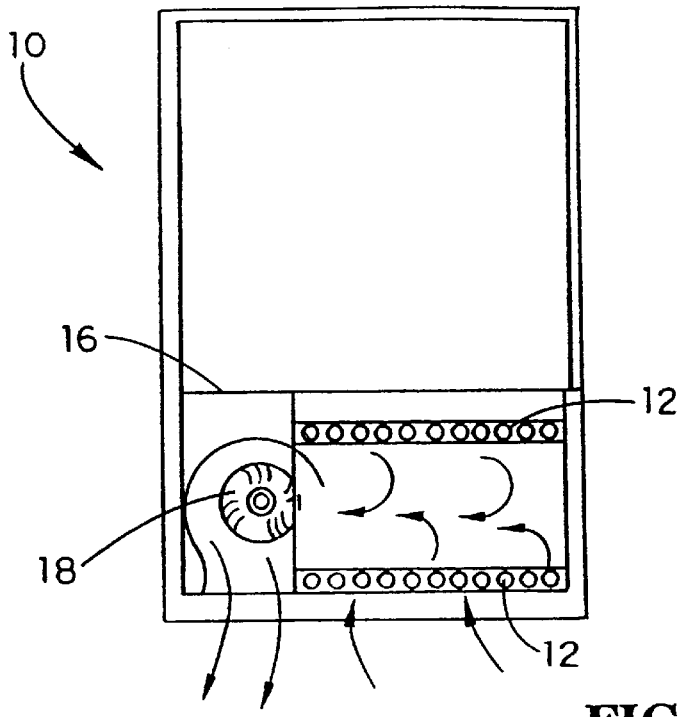
FIG. 3 is a side elevational, partially cut-away depiction of the air conditioner of FIGS. 1 and 2.
Figure 4:
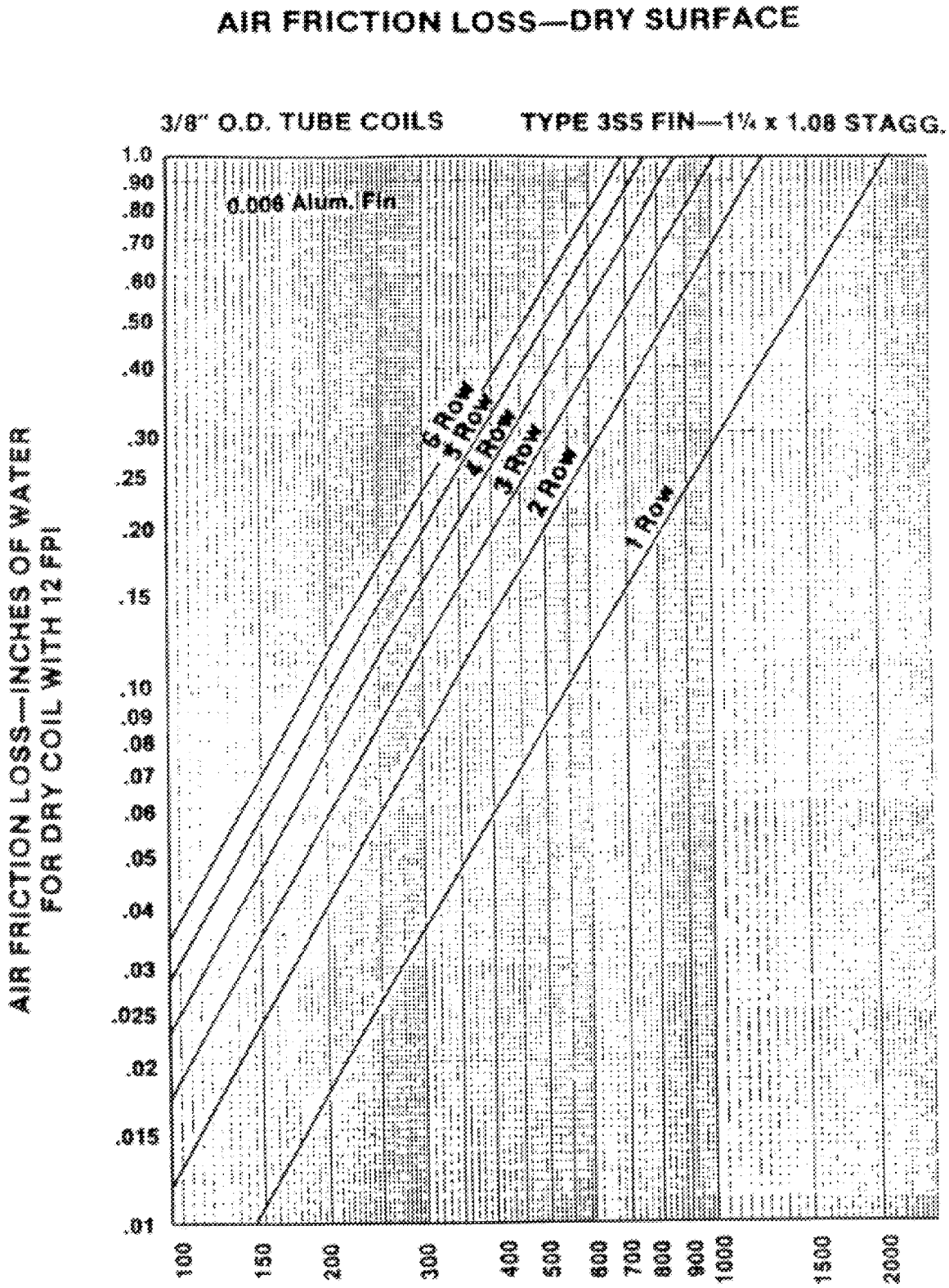
FIG. 4 is a chart which depicts a comparison of air friction parameters for single versus multiple layer evaporator coils of equal surface area.

Referring to FIGS. 1, 2 and 3, the evaporator coil 12 of the air conditioner 10 of the present invention is of a single layer, wrap-around design. This departs from conventional design which teaches placing a multiple layer evaporator coil assembly adjacent the room side face of a room air conditioner with a rearwardly positioned blower which draws air through the evaporator coil assembly for deflection (against the inner wall 16) through an effluent vent back into the room. The single layer evaporator coil 12 inherently creates less air friction, and produces less air flow noise than a multiple layer evaporator coil assembly, even if the coil surface areas are the same (See chart depicted in FIG. 4 for a comparison of air friction parameters for single versus multiple layer evaporator coils of equal surface area). However, certain design parameters of the air conditioner 10 of the present invention permit use of an evaporator coil of lesser surface area than units of comparable performance parameters.

Referring principally to FIG. 1, evaporator coil 12 of air conditioner 10 is positioned in the chassis 14 such that intake air which is drawn from the room for propulsion through the evaporator coil 12 flows, in part, between the inner wall 16 and one span of evaporator coil 12. This is important, because it lowers the temperature differential across the inner wall 16 when compared with air conditioners of conventional design.

An instructive example assumes an outside air temperature of 95° F., a room temperature of 80° F., and a evaporator coil effluent air temperature of 60° F. Because, in the present design, 80° F. room air circulates adjacent to inner wall 16, there is only a 15° F. temperature differential across inner wall 16. Conversely, according to conventional design, 60° F. evaporator coil effluent air flow lies directly across the inner wall 16, creating a 35° F. temperature differential. This design feature alone reduces the unit requirement for chassis insulation by approximately 57% compared with room air conditioners of equal performance with a resulting reduction in manufacturing costs.

Referring in combination to FIGS. 1, 2 and 3, the preferred embodiment of the present invention includes a blower 18 which is enveloped by front, side and rear spans or segments of evaporator coil 12. Alternative embodiments may include a blower which lies wholly or partially adjacent to evaporator coil 12, but, in any event, draws air through all four segments of evaporator coil 12 (generally as depicted by the air flow arrows shown in FIG. 1) for propulsion through an effluent vent 20.

Figure 5:
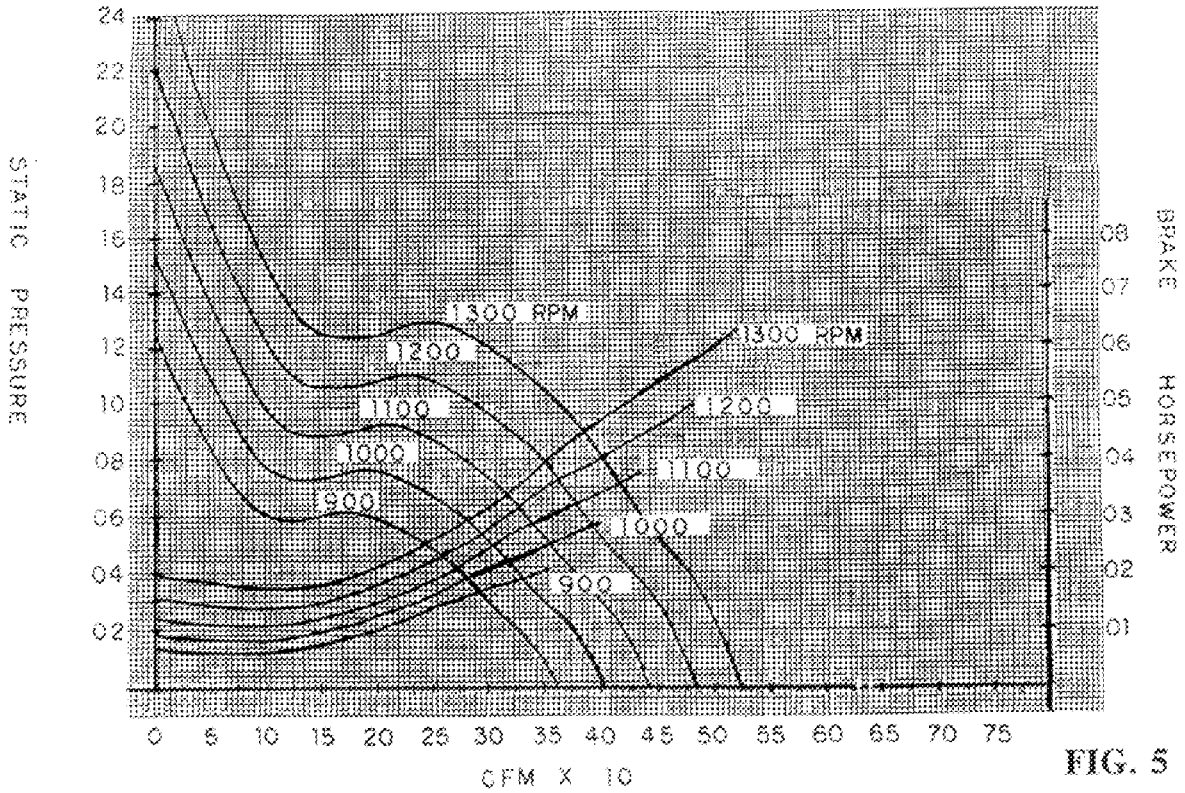
FIG. 5 is a chart which depicts the performance characteristics (Break horsepower consumed and volumetric air flow delivered) for a four inch in diameter and fifteen inch in length tangential blower operating at varying RPMs.

Blower 18 is of a tangential blower design. The performance chart of FIG. 5 depicts the performance characteristics of a four inch in diameter and fifteen inch in length tangential blower operating at varying RPMs. For each rotational speed (in RPMs), this chart shows the horsepower requirements and resulting air flow in CFM×10. As blower RPM is reduced, operating noise level is likewise reduced. Using the information depicted in FIG. 3, one may achieve a desired balance (or compromise, as the case may be) between energy consumption and operating noise level.

Figure 6:
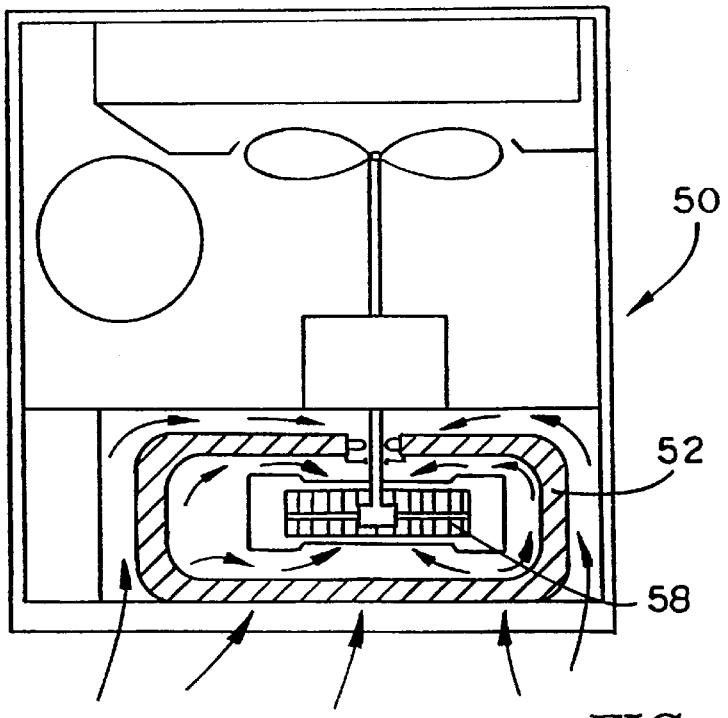
FIG. 6 is a top plan depiction of the component layout of an alternative embodiment of a room air conditioner of the present invention.
Figure 7:
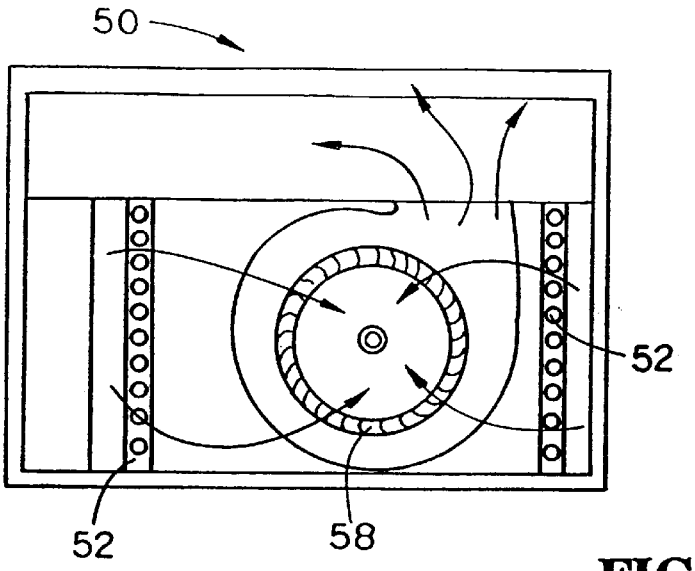
FIG. 7 is a front elevational, partially cut-away depiction of the air conditioner of FIG. 6.
Figure 8:
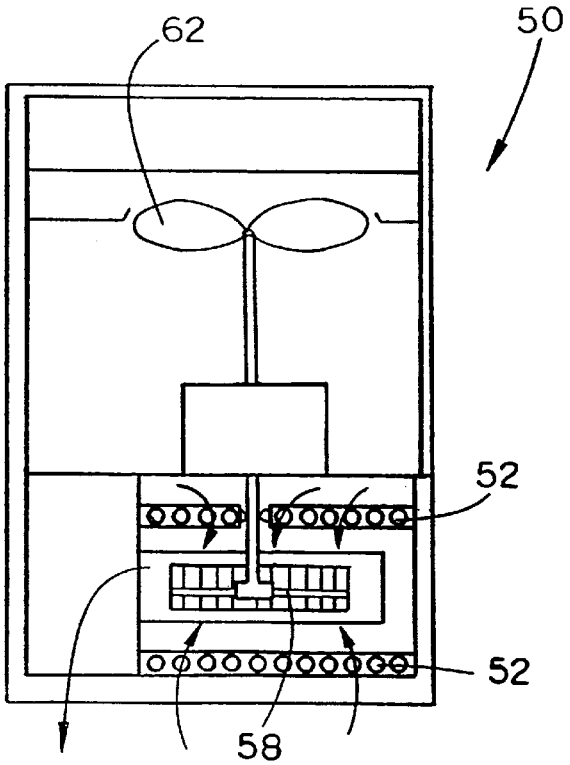
FIG. 8 is a side elevational, partially cut-away depiction of the air conditioner of FIGS. 6 and 7.

Referring in combination to FIGS. 6, 7 and 8, an alternative embodiment 50 of the present invention includes a blower 58 which may be either a single or double inlet type centrifugal blower, and which is arranged differently from the preferred embodiment of FIGS. 1. As is most clear from the top plan view of FIG. 5, this alternative embodiment 50 has blower 58 oriented such that a single motor 60 may operate both blower 58, as well as condenser fan 62 through use of a single shaft (or coaxial shafts) 64. Such dual use for a single motor 60 has obvious manufacturing costs benefits as well as efficiencies of operation.

As is depicted by the air flow arrows in FIG. 5, the air flow around and through evaporator coil 52 is substantially the same as in embodiment 10. Blower 58 is, in this embodiment (which utilizes an evaporator 52 of the same dimensions and specifications as described for embodiment 10), a single or double inlet centrifugal blower having two juxtaposed wheels, each eight inches in diameter and one inch±in width.

There are obviously many variations in dimensions, blower options, evaporator coil surface areas, etc. which would incorporate the present invention. This invention is not of a specific combination of components, but of a design concept which, regardless of the specific components, renders a highly desirable room air conditioner which is energy efficient, quite in operation, and highly cost effective to manufacture. Therefore, although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. An improved room air conditioner comprising:

an air conditioner chassis having a room side compartment and an exterior side compartment separated by an inner wall, said room side compartment being in vented communication with a interior structural space of a structure in a wall or window structure of which said air conditioner is installed, and said exterior side compartment being in vented communication with space opposite said wall or window structure which demarches said interior structural space, said room side compartment and said exterior compartment being substantially isolated from each other by said inner wall;

an elongate, single row evaporator coil assembly positioned in said room side compartment of said chassis and spatially separated from said inner wall, said evaporator coil assembly contoured for defining a plurality of evaporator coil assembly segments which collectively define a substantially closed perimeter of an interior coil space;

a tangential blower assembly positioned relative to said interior coil space for drawing air from said interior structural space substantially through space between said inner wall and said evaporator coil, through said evaporator coil assembly segments and into said interior coil space, and thereafter propelling said air through an effluent vent of said air conditioner and in a direction substantially away from said inner wall whereby contact between air cooled by said evaporator coil and said inner wall is minimized.

* * * * *